United States Patent [19]

Kautz

[11] 4,383,361

[45] May 17, 1983

[54] CONNECTOR INSERTION TOOL

[75] Inventor: Jon F. Kautz, Camp Hill, Pa.

[73] Assignee: AMP Incorporated, Harrisburg, Pa.

[21] Appl. No.: 303,280

[22] Filed: Sep. 17, 1981

[51] Int. Cl.[3] ..... H01R 43/00

[52] U.S. Cl. ..... 29/739; 29/758; 29/845

[58] Field of Search ..... 29/739, 741, 845, 747, 29/758, 764, 278, 837, 838

[56] References Cited

U.S. PATENT DOCUMENTS

| | | | |
|---|---|---|---|
| 4,089,104 | 5/1978 | Barry et al. | 29/739 |
| 4,206,543 | 6/1980 | Chisholm | 29/739 |
| 4,316,321 | 2/1982 | Wickham | 29/739 |

*Primary Examiner*—Carl E. Hall
*Assistant Examiner*—P. W. Echols
*Attorney, Agent, or Firm*—Allan B. Osborne

[57] ABSTRACT

The disclosed invention is an improvement to a card edge connector insertion tool. More particularly, the improvement includes a spring loaded guide block mounted on the insertion tool which enables the tool to be machine drivable for semi-automatically mounting a connector onto a printed circuit board.

3 Claims, 7 Drawing Figures

CONNECTOR INSERTION TOOL

A tool is disclosed in U.S. Pat. No. 4,089,104 for mounting a card edge connector onto a printed circuit board; i.e., driving or inserting the two rows of aligned contact pins depending from the connector into plated-through holes in the board. The connector housing mounts on the tool and ground the previously loaded contacts which are still attached to their selvedge strip. The housing functions as a support and guide for the contacts as they are inserted into the holes. The tool, loaded with the housing and contacts, is then lowered, driving the contact pins into the holes in the board. As set forth in the specification, the tool includes a rotating clamping bar with related mechanisms for clamping the connector contacts between a pair of connector support members. Further, the tool includes a detent subassembly and its related mechanism for engaging apertures in the selvedge strips for locating and initially retaining the contacts. The tool further includes a latching subassembly and its related mechanism for retaining the housing after it is placed onto the tool over the already loaded contacts. The selvedge strips are removed from the contacts after the connector has been mounted on the board.

The present invention is intended to provide an improvement to an insertion tool which is substantially simplified for inserting or driving the depending contact pins of a preassembled card edge connector into the holes in the board.

The improvement is, according to the present invention, therefore characterised in having a guide block which is spring mounted to the tool housing and through which the push pins of the tool extend. The guide block straightens the connector and further guides the push pins into the connector housing and into contact with shoulders on the contacts therein against which the driving force is exerted. As the tool is being withdrawn, the spring loaded guide block exerts a downward force on the connector to steady it from being moved by the retreating push pins.

For a better understanding of the invention reference will now be made by way of example to the accompanying drawings, in which.

Figures 1, 2:
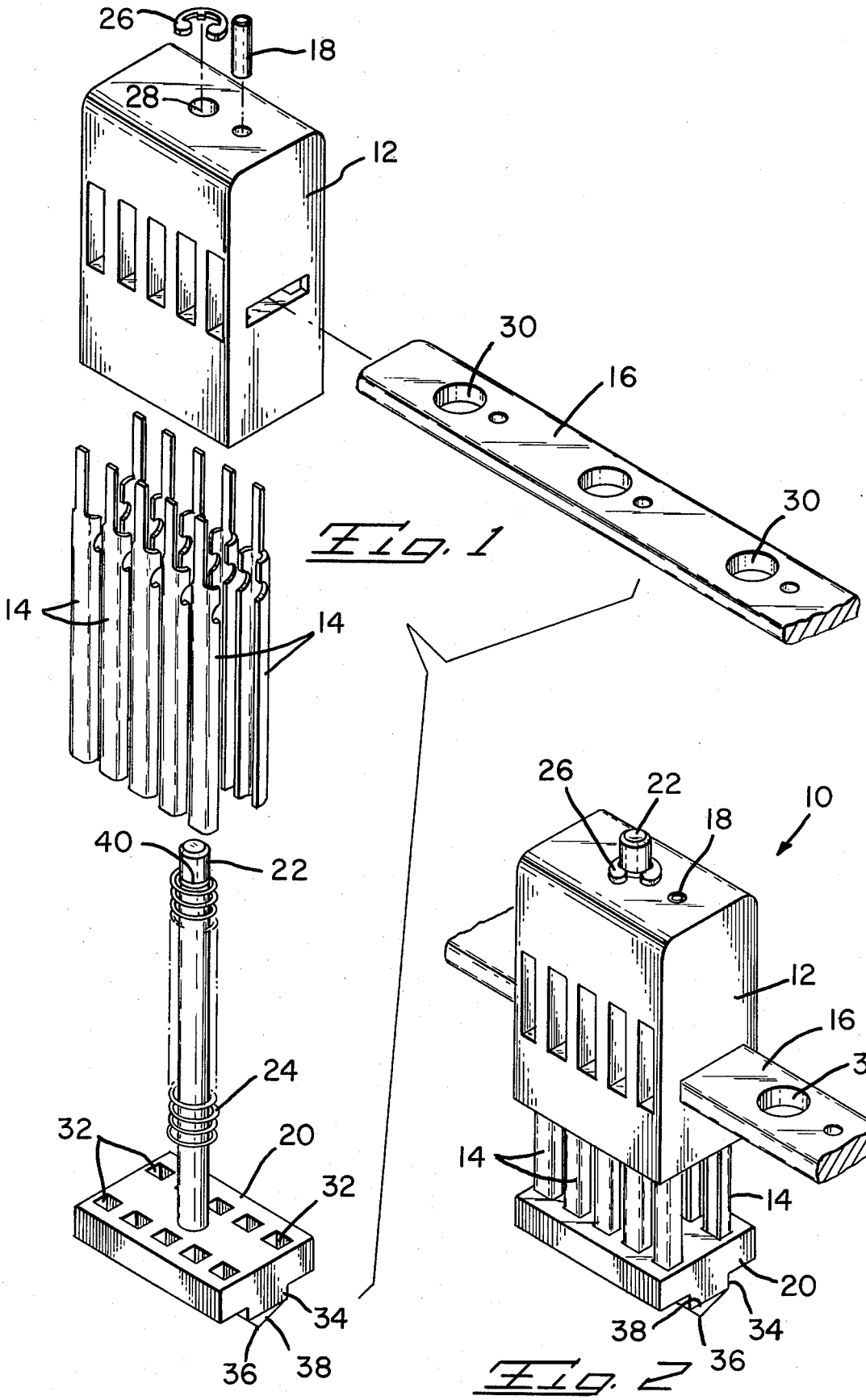
FIG. 1 is a perspective and exploded view of an insertion tool module with the improvement therefore constructed in accordance with the present invention.
FIG. 2 is a perspective view of the tool module and improvement assembled together.

An insertion tool consists of one or more modules 10 (FIG. 2) which includes the components exploded out in FIG. 1. These components include housing 12, push pins 14, retaining bar 16, and roll pin 18. The push pins 14 are held in housing 12 by bar 16. Bar 16 in turn is held in the housing by roll pin 18. The bar is shown as having a length greater than the housing to indicate that a number of modules may be mounted on one bar to make an insertion tool of a desired length.

Module 10 is disclosed in copending U.S. patent application Ser. No. 263,377, filed May 13, 1981 by Ralph Richard Goss and assigned to the same assignee as the present invention. That disclosure is incorporated herein fully by reference.

The improvement of the present invention, shown in exploded fashion in FIG. 1, includes guide block 20, shaft 22, coil spring 24 and retaining ring 26.

Module 10 must be modified by adding vertical hole 28 through housing 12 and hole 30 through bar 16.

Guide block 20 is preferably made from glass filled NYLON although other suitable materials can be used. Holes 32 extend vertically through the block on a spacing such as to receive push pins 14 therethrough as shown in FIGS. 2–7.

A depending, elongated guide member 34 is located on the underside of the block and centered between the sides thereof. The sides of the member are straight for a short distance and then converge in to form a tip 36. The ends of the member are preferably beveled as indicated by reference numeral 38.

Block 20 further includes means to centrally receive shaft 22 such as a threaded hole or the like.

The upper end of shaft 22 is circumferentially grooved, indicated by reference numeral 40, to receive retaining ring 26.

FIG. 2 shows a one module insertion tool 10 with the improvement of the present invention assembled thereto. First shaft 22 is secured to block 20 by any conventional means. Coil spring 24 is placed on the shaft and the free end of the shaft pushed into housing 12 from below with push pins 14 being guided into holes 32. The shaft is pushed upwardly through hole 30 in bar 16 and hole 28 in housing 12. Upon groove 40 clearing the top of housing 12, retaining ring 26 is located therein to lock the improvement to the module.

Figure 3:
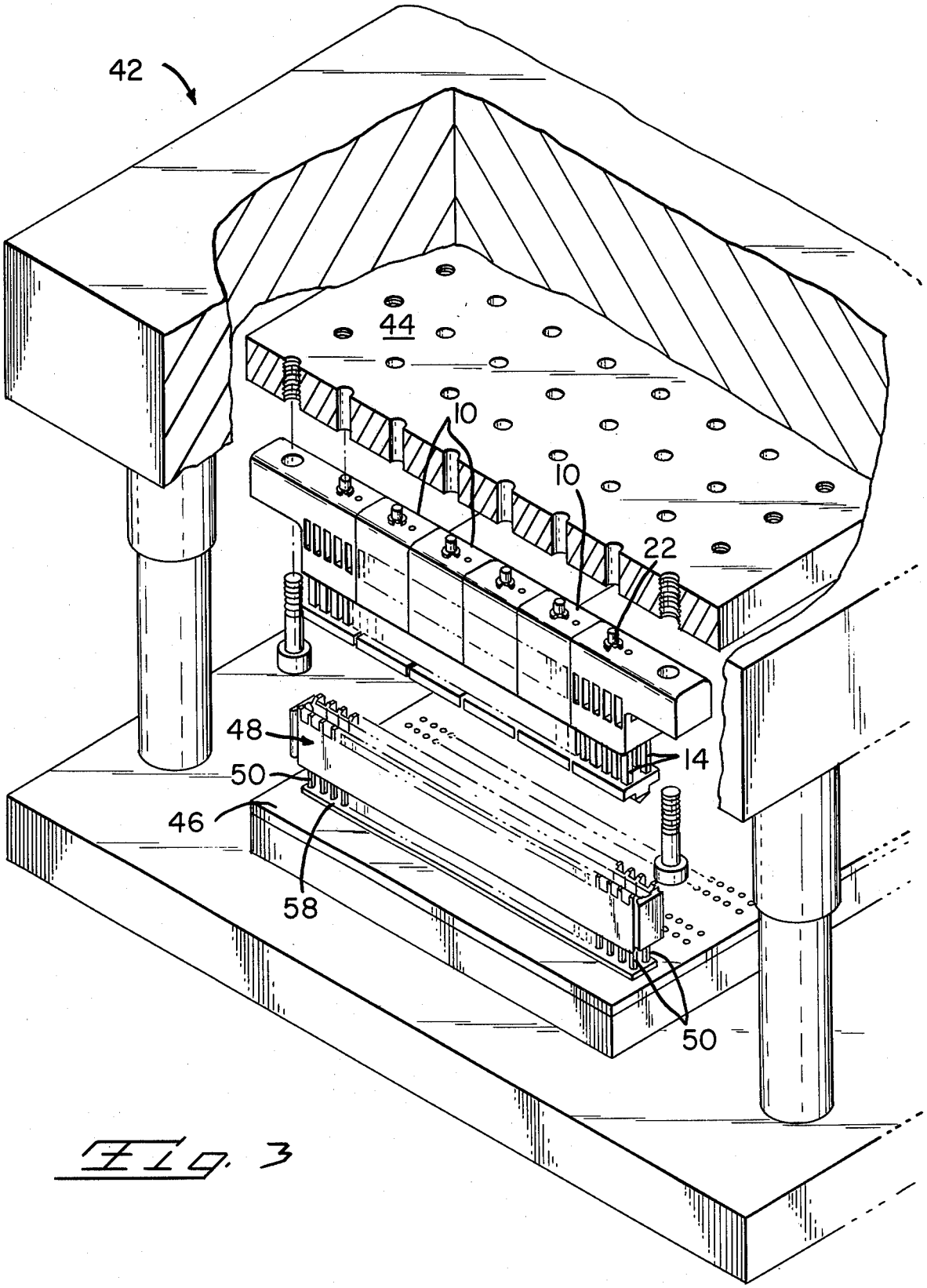
FIG. 3 is a perspective view showing several improved tool modules joined together and mounted on an arbor press for driving the contact pins of a card edge connector into a printed circuit board.

FIG. 3 shows a press 42 having a vertically moving plate 44 to which an insertion tool 10 composed of several modules will be secured with push pins 14 and guide blocks 20 depending therefrom. A printed circuit board 46 is positioned below with a card edge connector 48 thereon ready for the insertion of its pins.

Plate 44 can carry a plurality of insertion tools so that a plurality of connectors 48 can be mounted on board 46 simultaneously.

FIGS. 4 through 7 illustrate how the improved insertion tool works.

Figure 4:
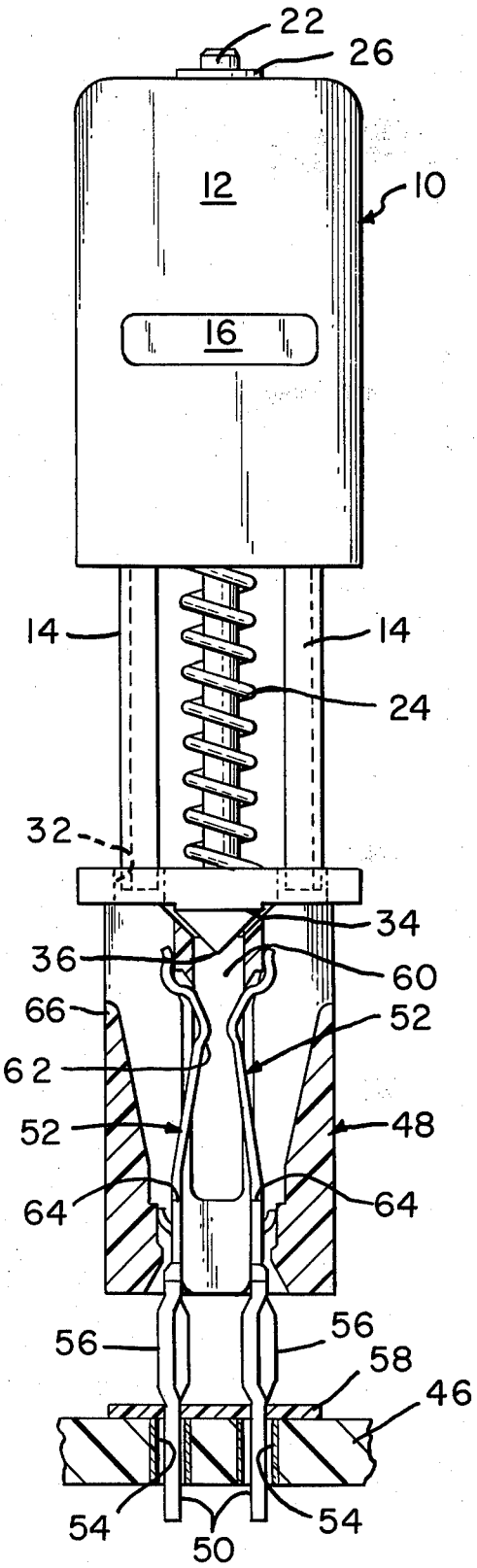
FIGS. 4 through 7 are cross-sectional views showing the several steps in driving the contact pins into the board.

With reference to FIG. 4, the pins 50 of contacts 52, depending from connector 48, have been pushed into plated-through holes 54 on board 46 down to where the retaining sections 56 on the pins are just ready to enter the holes. As is well known, considerable force is required to drive the retaining sections 56 into holes 54. Mylar strips 58 on the pins have held them in proper alignment relative to holes 54 during this step which was done manually.

In FIG. 4, the insertion tool is shown being lowered with guide block 20 resting on top of connector 48. As the tool was brought down guide member 34 on block 20 entered card edge receiving slot 60 in connector 48 and, if the connector had been placed on the board crooked, the tip straightens it up as it entered the slot.

Figure 5:
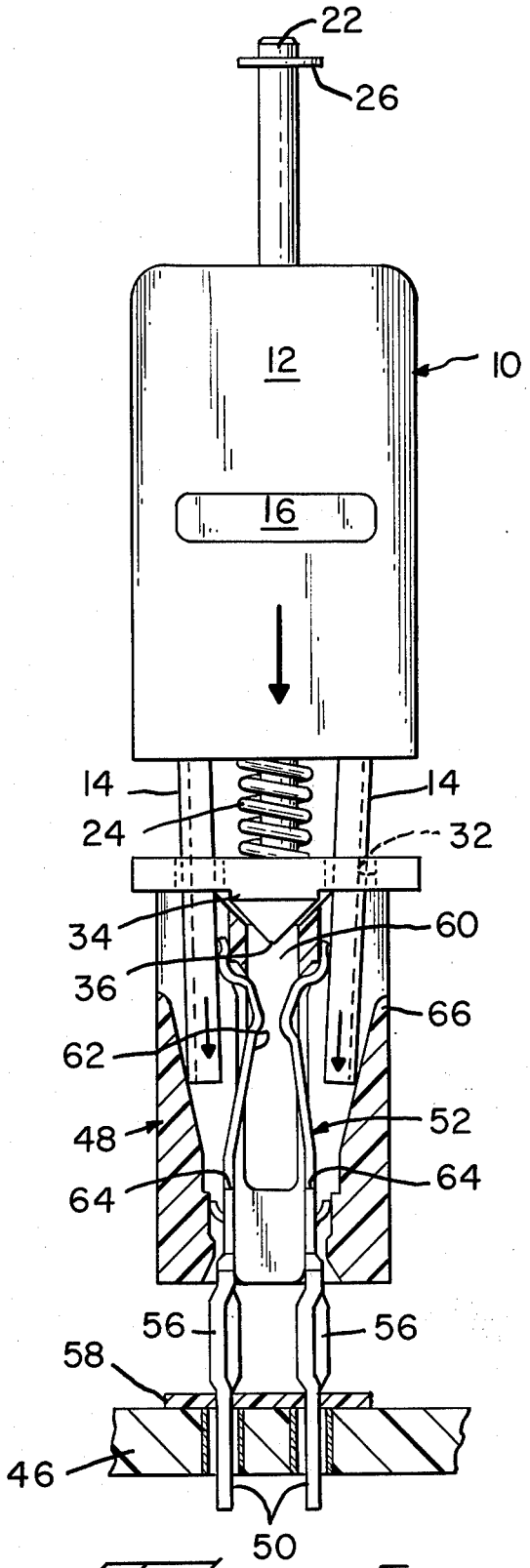

FIG. 5 shows the tool being lowered further with push pins 14 entering connector 48 with holes 32 in guide block 20 aligning them with the upper portions 62 of contacts 50. Coil spring 24 is being compressed and shaft 22 is rising above housing 12.

Figure 6:
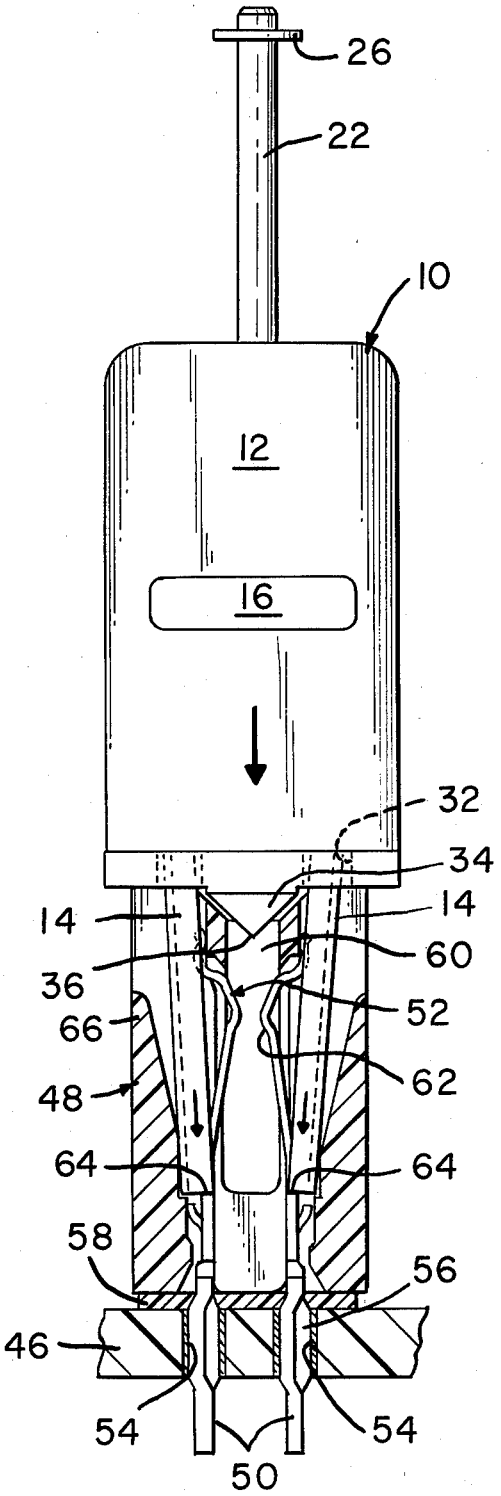

In FIG. 6, the guided push pins 14 have landed and bottomed out on shoulders 64 on contacts 50. Further, housing 12 has bottomed out on block 20. Accordingly, further downward travel of tool 10 drives retaining sections 56 into holes 54 in board 46. The predominant driving force is on shoulders 64 so that connector housing 66 will not be damaged.

Figure 7:
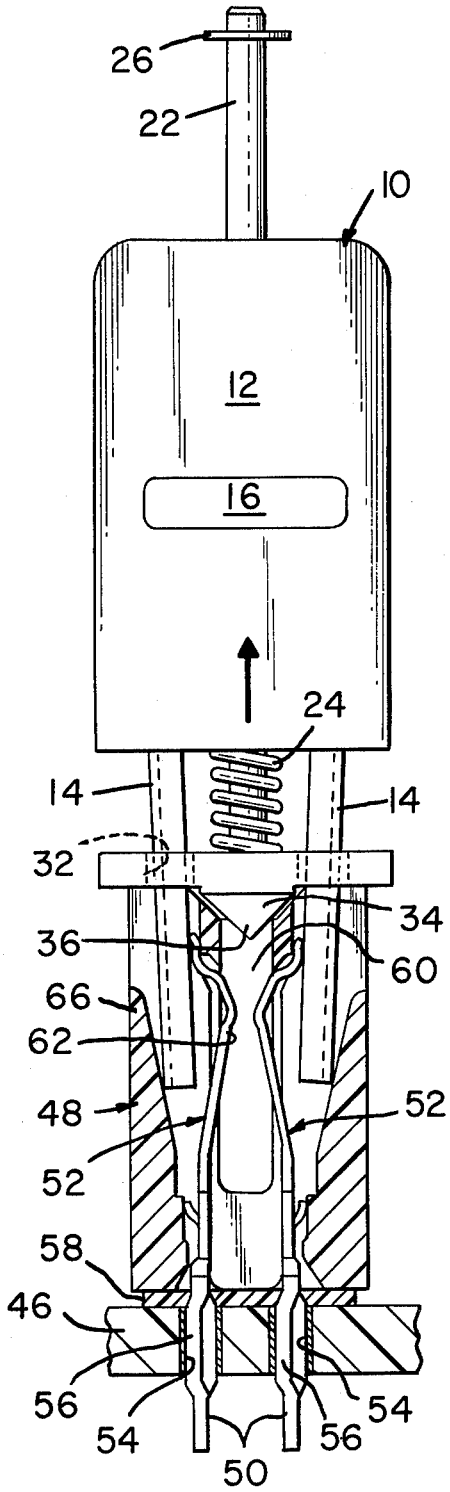

FIG. 7 shows tool 10 being withdrawn. As it does so, coil spring exerts a downward force on connector 48 through block 20. Thus, any frictional drag between push pins 14 and the connector will not dislodge the connector.

I claim:

1. An improvement to a tool (10) for mounting a connector (48) having contacts (52) with contact pins (50) onto a printed circuit board (46), said tool (10) comprising a housing 12 containing a plurality of depending push pins (14) arranged in identical spacing as the contacts (52), said improvement comprising a vertically sliding shaft (22) in the housing (12) with a guide block (20) attached to the free end of the shaft (22) below the housing (12), said guide block (20) having a plurality of holes (32) extending vertically therethrough with the holes (32) being arranged to conformably receive the push pins (14) therethrough so that as the guide block (20) is placed on top of the connector (48) the push pins (14) are guided by the holes (32) in said guide block (20) into the connector (48) to engage contact shoulders (64) against which an insertion force is applied by the tool (10) to drive the contact pins (50) into holes (54) in the circuit board (46).

2. The improvement of claim 1 further including a coil spring (24) mounted on the shaft (22) between the housing (12) and the guide block (20) and compressible therebetween as the push pins (14) are driven against the contact shoulders (64) so that the coil spring (24) biases the guide block (20) against the top of the connector (48) to steady it as the push pins (14) are withdrawn therefrom.

3. The improvement of claims 1 or 2 further including an elongated member (34) on and depending from the underside of guide block (20), said member (34) having a tip (36) for entering the card edge receiving slot (60) in the connector (48) to align the connector (48) with the guide block (20).

* * * * *